US011601771B2

(12) United States Patent
Imai et al.

(10) Patent No.: US 11,601,771 B2
(45) Date of Patent: Mar. 7, 2023

(54) AUDIO SIGNAL PROCESSING APPARATUS AND AUDIO SIGNAL PROCESSING METHOD FOR CONTROLLING AMOUNT OF FEED TO BUSES

(71) Applicant: YAMAHA CORPORATION, Hamamatsu (JP)

(72) Inventors: Arata Imai, Hamamatsu (JP); Shunichi Kamiya, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 17/155,741

(22) Filed: Jan. 22, 2021

(65) Prior Publication Data

US 2021/0235211 A1 Jul. 29, 2021

(30) Foreign Application Priority Data

Jan. 29, 2020 (JP) ..... JP2020-012289

(51) Int. Cl.
*H04R 5/04* (2006.01)
*H04S 1/00* (2006.01)

(52) U.S. Cl.
CPC ..... *H04S 1/002* (2013.01); *H04R 5/04* (2013.01); *H04S 1/007* (2013.01); *H04R 2420/01* (2013.01)

(58) Field of Classification Search
CPC ..... H04S 1/007; H04R 5/04; H04R 2420/01
USPC ..... 381/119
See application file for complete search history.

(56) References Cited

U.S. PATENT DOCUMENTS

2010/0239107 A1* 9/2010 Fujita ..... H04H 60/04 381/119
2014/0328503 A1* 11/2014 Shirai ..... G10H 1/46 381/119
2016/0285573 A1 9/2016 Terada
2019/0191261 A1* 6/2019 Saito ..... H04S 7/30
2019/0246227 A1* 8/2019 Imai ..... H04R 3/12
2019/0356291 A1* 11/2019 Saito ..... H03G 3/14

FOREIGN PATENT DOCUMENTS

JP 2016181834 A 10/2016

* cited by examiner

*Primary Examiner* — James K Mooney
(74) *Attorney, Agent, or Firm* — Rossi, Kimms & McDowell LLP

(57) ABSTRACT

An audio signal processing apparatus includes a first bus, a second bus, and a controller that assigns a first input channel to the first bus, assigns a second input channel to the second bus, receives an amount of feed from the first input channel to the first bus, and receives an amount of feed from the second input channel to the second bus.

20 Claims, 10 Drawing Sheets

AUDIO SIGNAL PROCESSING APPARATUS AND AUDIO SIGNAL PROCESSING METHOD FOR CONTROLLING AMOUNT OF FEED TO BUSES

CROSS REFERENCE TO RELATED APPLICATIONS

This Nonprovisional application claims priority under 35 U.S.C. § 119(a) on Patent Application No. 2020-012289 filed in Japan on Jan. 29, 2020, the entire contents of which are hereby incorporated by reference.

BACKGROUND

Technical Field

An embodiment according to the present disclosure relates to an audio signal processing apparatus and an audio signal processing method that perform predetermined processing on an audio signal.

Background Information

Japanese Unexamined Patent Application Publication No. 2016-181834 discloses an audio mixer that is able to assign an operation object to each channel strip.

SUMMARY

It is an object of the present disclosure to provide an audio signal processing apparatus and an audio signal processing method that are able to easily control an amount of feed to a different bus.

An audio signal processing apparatus includes a first bus, a second bus, and a controller that assigns a first input channel to the first bus, assigns a second input channel to the second bus, receives an amount of feed from the first input channel to the first bus, and receives an amount of feed from the second input channel to the second bus.

An audio signal processing apparatus is able to assign each of a plurality of input channels to any different bus, and set an amount of feed for each of the plurality of input channels.

DETAILED DESCRIPTION

A user of an audio mixer, in a case of sending an audio signal of a plurality of input channels to a certain bus (a MIX bus for a monitor, for example), may change the content of signal processing for each input channel. For example, to a MIX bus for a monitor of a vocal, there may be a case in which the user would like to do nothing to the voice of the vocal but to perform localization processing on other sounds (the voice of a chorus, for example).

In view of the foregoing, an audio signal processing apparatus according to an embodiment of the present disclosure assigns a first input channel to a first bus, assigns a second input channel to a second bus, and sets an amount of feed to each of a plurality of input channels. Accordingly, the user can easily set the amount of feed of an audio signal of the first input channel that performs localization processing, and the amount of feed of an audio signal of the second input channel that does not perform the localization processing.

Figure 1:
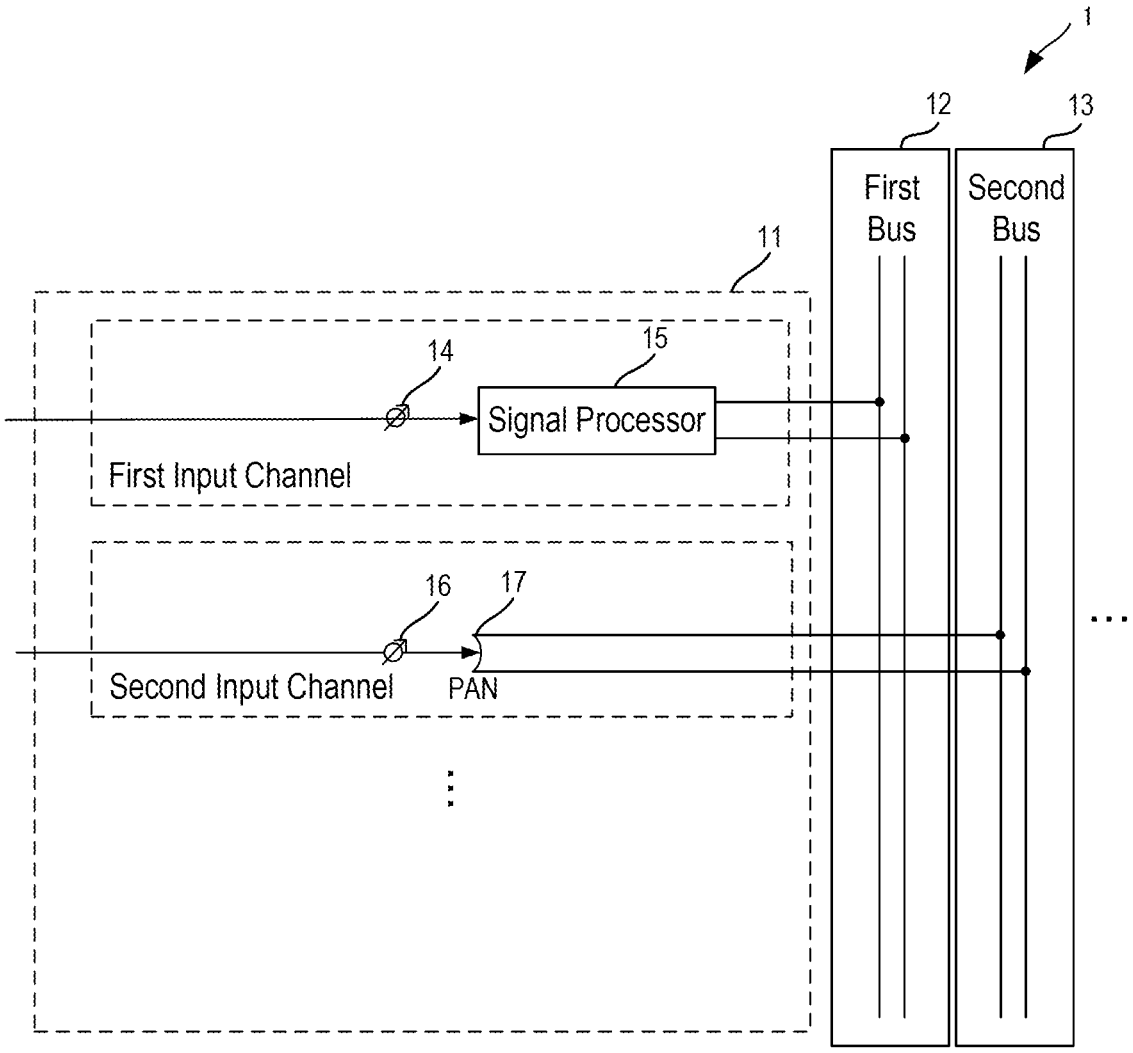
FIG. 1 is a diagram showing a schematic configuration of an audio signal processing apparatus.

FIG. 1 is a diagram showing a schematic configuration of an audio mixer 1 as an example of the audio signal processing apparatus. The audio mixer 1 includes an input channel block 11, a first bus 12, and a second bus 13. The input channel block 11 includes a plurality of input channels. A first input channel includes a send level adjustment circuit 14 and a signal processor 15. A second input channel includes a send level adjustment circuit 16 and a PAN 17. The first input channel is assigned to the first bus 12. The second input channel is assigned to the second bus 13. The first bus 12 and the second bus 13 are stereo buses. However, in the present disclosure, the first bus and the second bus are not limited to a stereo bus.

The send level adjustment circuit 14 adjusts an amount of feed to the first bus of an audio signal of the first input channel. The send level adjustment circuit 16 adjusts an amount of feed to the second bus of an audio signal of the second input channel.

The amount of feed of the send level adjustment circuit 14 and the send level adjustment circuit 16 is received through a knob (a rotation operation element) provided in a channel strip or a physical operation element (see FIG. 5) such as a fader, for example.

The signal processor 15 performs predetermined signal processing to the audio signal of the first input channel. The predetermined signal processing may be any type of processing, but includes processing that adds localization, for example. Accordingly, localization addition processing is performed on the audio signal of the first input channel. The localization processing is processing that convolves a head-related transfer function to an audio signal, for example. The head-related transfer function represents a transfer function between a predetermined position and an ear of a listener. The head-related transfer function corresponds to an impulse response expressing the loudness, the reaching time, the frequency characteristics and the like of a sound emitted from a virtual sound source placed in a certain position to each of right and left ears. The signal processor 15 applies a head-related transfer function for an L channel and a head-related transfer function for an R channel to an inputted audio signal. As a result, the signal processor 15 generates a stereo signal to be sent out to the first bus.

The PAN 17 is a circuit that adjusts a distribution ratio (level balance) of the second input channel that sends out to the second bus 13 being a stereo bus. The level balance is received through the knob (see FIG. 5) provided in a channel strip, for example. Any localization processing other than right and left localization by the PAN is not performed on the audio signal of the second input channel.

Therefore, when the voice of a chorus is inputted into the first input channel, and the voice of a vocal is inputted into the second input channel, for example, the localization addition processing is performed on the voice of a chorus. When a listener listens to monitor sound using headphones, the voice of a chorus is localized around the listener. The voice of a vocal is localized in the head of the listener. A user of the audio mixer 1 can easily adjust each amount of feed to a bus that sends out the voice of a vocal and a bus that sends out the voice of a chorus.

It is to be noted that the audio signal of the first bus and the audio signal of the second bus may be respectively outputted to different output destinations, and may be mixed and outputted to the same output destination (an AUX Send, for example).

Figure 2:
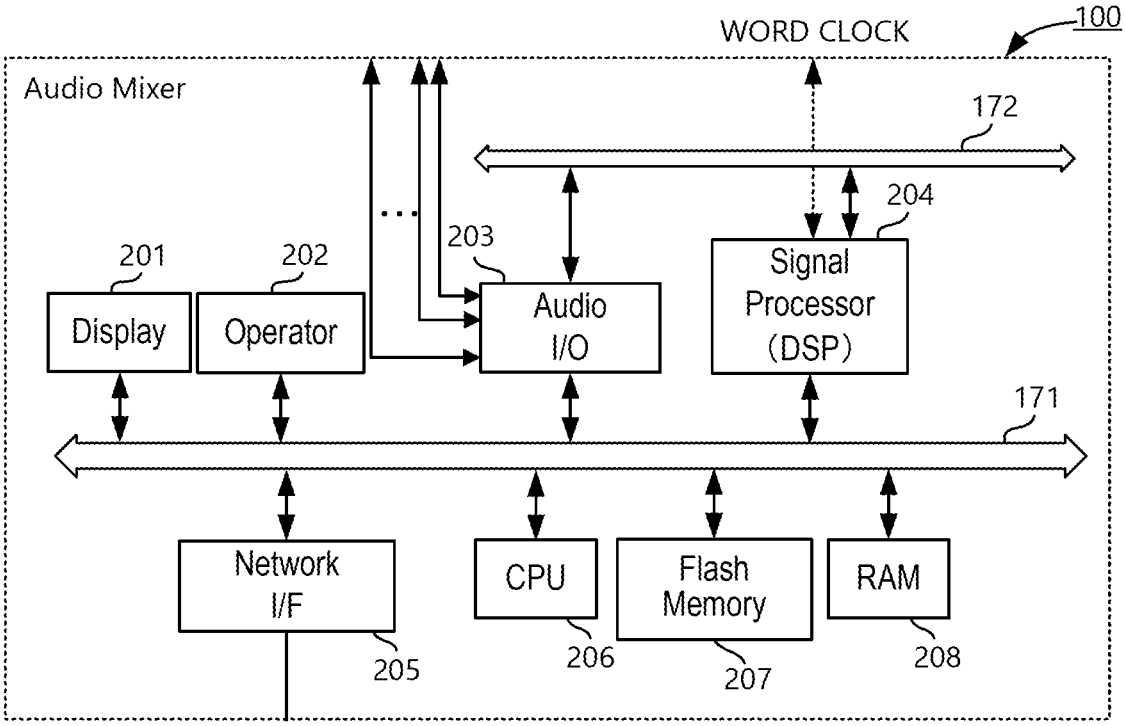
FIG. 2 is a block diagram showing a configuration of an audio mixer.

A further specific configuration will be hereinafter described. FIG. 2 is a block diagram showing a configuration of an audio mixer 100. The audio mixer 100 includes components such as a display 201, an operator 202, an audio I/O 203, a signal processor 204, a network I/F 205, a CPU 206, a flash memory 207, and a RAM 208.

These components are connected to each other through a bus 171. In addition, the audio I/O 203 and the signal processor 204 are also connected to a waveform bus 172 for transmitting a digital audio signal.

The CPU 206 is a controller that controls the operation of the audio mixer 100. The CPU 206 reads and implements a predetermined program stored in the flash memory 207 being a storage medium to the RAM 208 and performs various types of operations. It is to be noted that the program may be stored in a server. The CPU 206 may download the program from the server through a network and may execute the program.

The signal processor 204 is configured by a DSP for performing various types of signal processing such as mixing processing or effect processing. The signal processor 204 performs effect processing such as mixing or equalizing on an audio signal received through the network I/F 205 or the audio I/O 203. The signal processor 204 outputs a digital audio signal on which the signal processing has been performed, through the audio I/O 203 or the network I/F 205.

Figure 3:
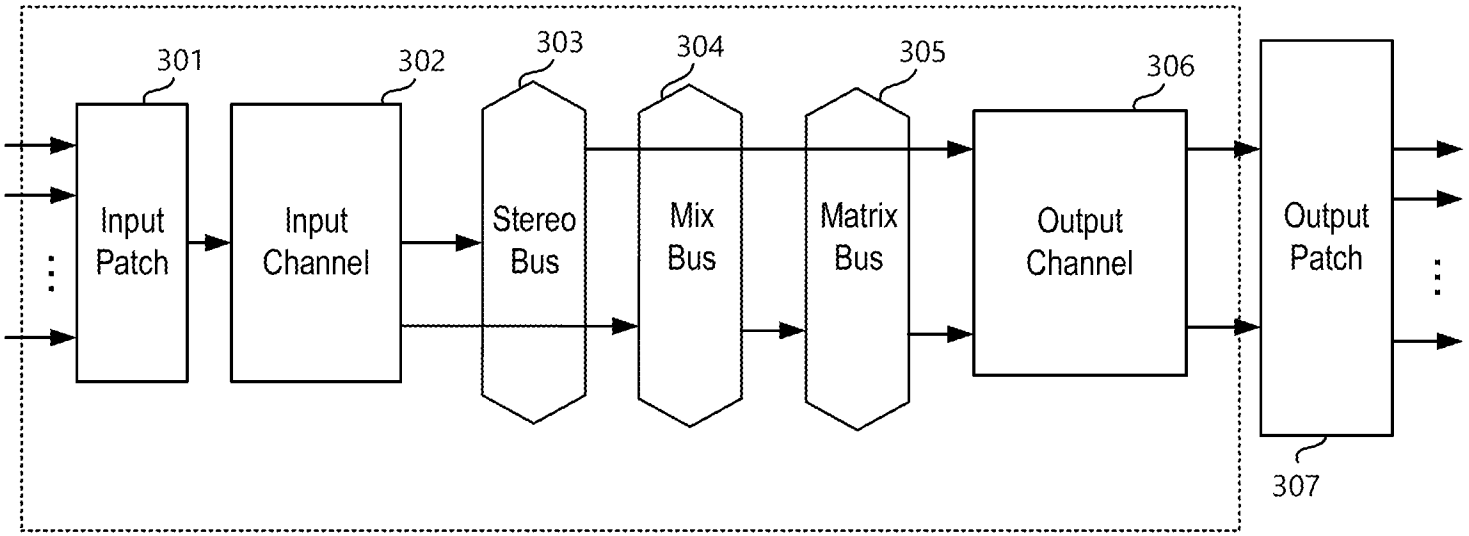
FIG. 3 is an equivalent block diagram of signal processing to be performed by a signal processor, an audio I/O, and a CPU.

FIG. 3 is a block diagram showing a functional configuration of signal processing to be performed in the signal processor 204, the audio I/O 203 (or the network I/F 205), and the CPU 206. As shown in FIG. 3, the signal processing is functionally performed through an input patch 301, an input channel 302, a stereo bus 303, a MIX bus 304, a matrix bus 305, an output channel 306, and an output patch 307.

Figure 4:
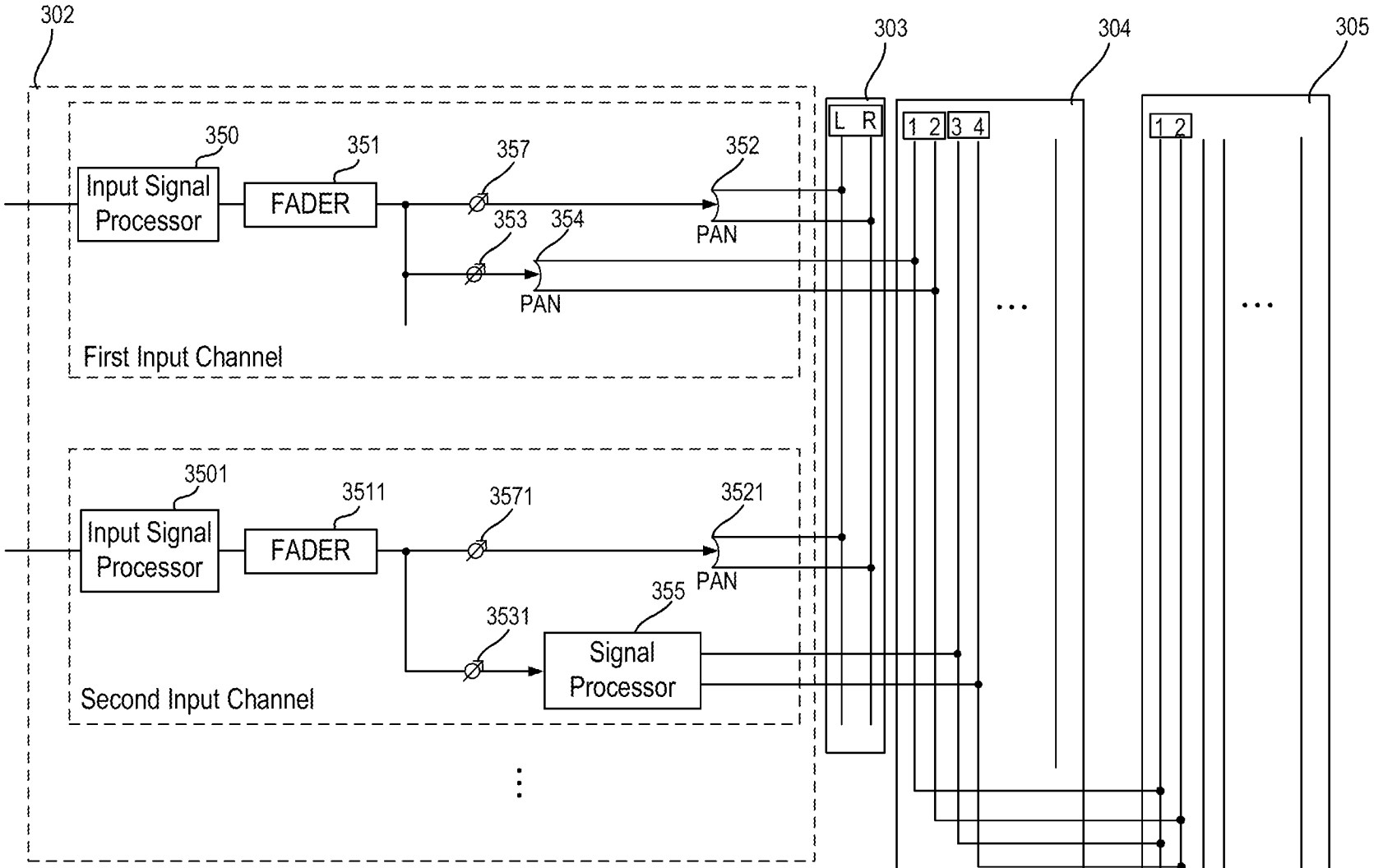
FIG. 4 is a diagram showing a configuration of an input channel and a bus.

The input patch 301 supplies an audio signal to each channel of the input channel 302. FIG. 4 is a diagram showing a configuration of the input channel. The each channel of the input channel 302 performs signal processing on the audio signal supplied from the input patch 301.

The first input channel includes an input signal processor 350, a FADER 351, a PAN 352, a send level adjustment circuit 353, a PAN 354, and a level adjustment circuit 357. The second input channel includes an input signal processor 3501, a FADER 3511, a PAN 3521, a send level adjustment circuit 3531, a signal processor 355, and a level adjustment circuit 3571.

Figure 5:
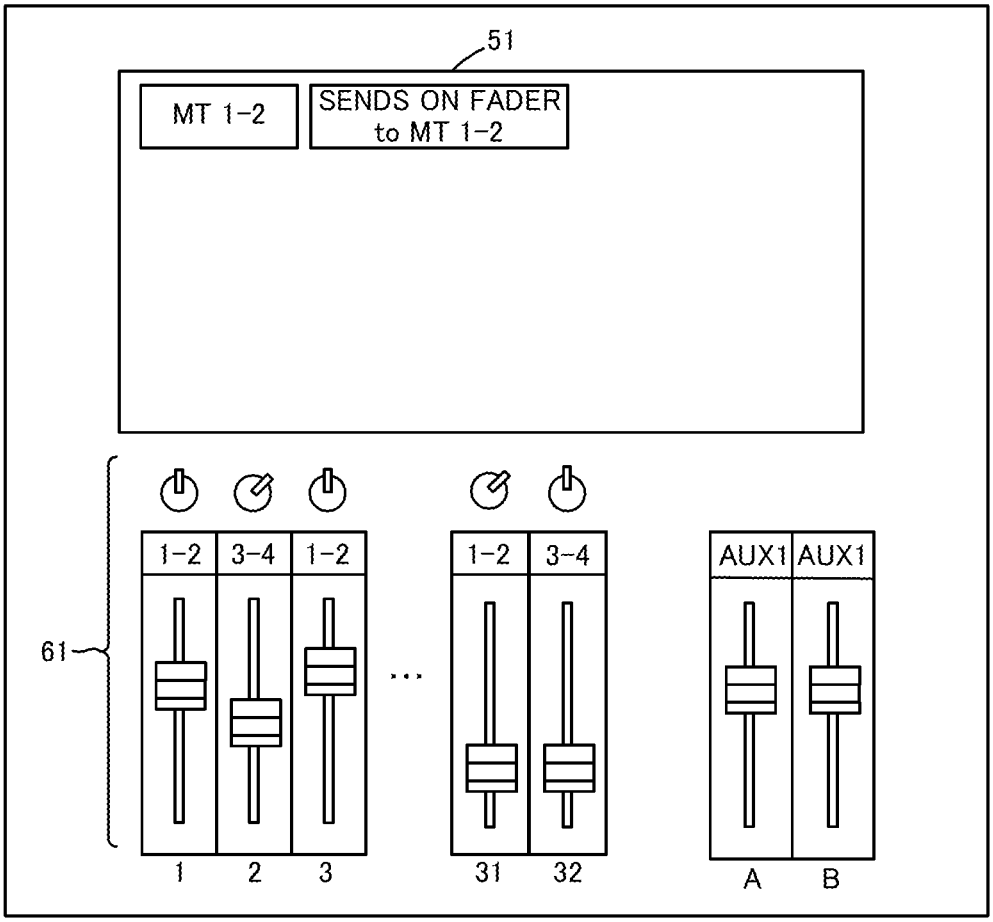
FIG. 5 is a diagram showing an example of a principal portion of an operation panel.

The input signal processor 350 and the input signal processor 3501 perform signal processing such as equalizing or compressing. The FADER 351 and the FADER 3511, as a first mode, adjust the gain of each input channel. The FADER 351 and the FADER 3511 each correspond to an operation element provided on an operation panel shown in FIG. 5. It is to be noted that either the configuration of the input signal processor 350 and the input signal processor 3501 or the configuration of the FADER 351 and the FADER 3511 may be provided in a preceding stage or a subsequent stage. FIG. 5 is a diagram showing an example of a principal portion of an operation panel. The operation panel includes a plurality of channel strips 61 that correspond one-to-one to a plurality of channels. Each of the plurality of channel strips 61 includes a fader and a knob that are vertically disposed side by side. The user of the audio mixer 1, by sliding the position of the fader, adjusts the gain of the audio signal of a corresponding input channel.

The knob corresponds to the PANs 352 and 3521 of FIG. 4. The user of the audio mixer 1, by turning the knob clockwise or counterclockwise, adjusts the level balance of a stereo. The audio signal distributed by the PANs 352 and 3521 is sent out to the stereo bus 303. The audio signal to be sent out to the stereo bus 303 is level-adjusted in the level adjustment circuits 357 and 3571.

The stereo bus 303 is a bus corresponding to a main speaker in a hall or a conference room. The stereo bus 303 mixes an audio signal to be sent out from each input channel. The stereo bus 303 outputs a mixed audio signal to the output channel 306. The output channel 306 performs signal processing such as equalizing or compressing on the audio signal that the stereo bus 303 has outputted. The output channel 306 outputs the audio signal on which the signal processing has been performed, to the output patch 307.

The output patch 307 assigns each channel of the output channel to any one of a plurality of ports serving as an analog output port or a digital output port. As a result, the audio signal on which the signal processing has been performed is supplied to the audio I/O 203.

In addition, each channel of the input channel 302 sends out the audio signal on which the signal processing has been performed, to the MIX bus 304.

The MIX bus 304 is a bus for sending out an audio signal of one or more input channels to a specific location such as a monitor speaker or monitor headphones. However, in the present embodiment, the audio signal, even when being sent out to the same monitor speakers or the same headphones, is outputted to a different bus.

In the example of FIG. 4, the audio signal of the first input channel is sent out to a MIX1 bus and a MIX2 bus. The audio signal of the second input channel is sent out to a MIX3 bus and a MIX4 bus. The audio signal of the first input channel is level-adjusted in the send level adjustment circuit 353. The audio signal of the first input channel is distributed in the PAN 354, and the distributed audio signals are sent out to a MIX1 bus and a MIX2 bus, respectively. The audio signal of the second input channel is level-adjusted in the send level adjustment circuit 3531. The audio signal of the second input channel is subjected to signal processing in the signal processor 355. The signal processor 355, as with the signal processor 15 shown in FIG. 1, performs predetermined signal processing to the audio signal of the second input channel. The predetermined signal processing may be any type of processing, but includes processing that adds localization, for example. Accordingly, localization addition processing is performed on the audio signal of the second input channel. The localization processing, as described above, is processing that convolves a head-related transfer function to an audio signal, for example.

The audio signal of the second input channel on which the signal processing has been performed in the signal processor 355 is sent out to the MIX3 bus and the MIX4 bus.

The MIX bus 304 is routed to the matrix bus 305. In the example of FIG. 4, the audio signals of the MIX1 bus and the MIX2 bus and the audio signals of the MIX3 bus and the MIX4 bus are sent out to the matrix bus 305. The matrix bus 305 mixes the audio signals of the MIX1 bus and the MIX3 bus into a matrix 1 bus. In addition, the matrix bus 305 mixes the audio signals of the MIX2 bus and the MIX4 bus into a matrix2 bus.

The matrix1 bus is patched to the L channel of headphones, for example. The matrix2 bus is patched to the R channel of headphones, for example. As a result, the audio signals of the first input channel and the second input channel are supplied to the L channel and the R channel of the headphones.

Therefore, when the voice of a vocal is inputted into the first input channel, and the voice of a chorus is inputted into the second input channel, for example, the localization addition processing is performed on the voice of a chorus. When a listener listens to monitor sound using the headphones, the voice of a chorus is localized around the listener. The voice of a vocal is localized in the head of the listener.

A user of the audio mixer 100 according to the present embodiment can easily adjust each amount of feed to a bus that sends out the voice of a vocal and a bus that sends out the voice of a chorus. Further, as shown in the following FIG. 5 to FIG. 7, The user of the audio mixer 100 according to the present embodiment can easily set the input channel on which the localization addition processing is to be performed and the input channel on which the localization addition processing other than the localization by the PAN is not performed.

As shown in FIG. 5, the specific matrix bus (an MT1-2 bus in the example of FIG. 5) of the matrix bus 305 is displayed on a touch screen 51. The touch screen 51 includes a display 201 and an operator 202. When the user touches "SENDS ON FADER to MT 1-2" displayed on the touch screen 51, the audio mixer 100 shifts to a SENDS ON FADER mode (a second mode) in which the fader of the channel strip 61 is caused to function as an operation element for setting an outgoing level from an input channel to a bus. It is to be noted that this example shows an example in which the audio mixer 100 shifts to the SENDS ON FADER mode through the touch screen 51 as an example of a mode switch receiver. However, the audio mixer 100 may include an exclusive physical operation element for setting the outgoing level from an input channel to a bus, and may shift to the SENDS ON FADER mode through the operation element. In addition, the audio mixer 100 includes a physical operation element to which a user is able to assign any function, and may assign a function to shift to the SENDS ON FADER mode to the physical operation element, and may shift to the SENDS ON FADER mode when the user operates the physical operation element.

In the example of FIG. 5, the matrix 1-2 bus is selected as an outgoing destination. The physical operation element of each fader of the channel strip 61 corresponds to the input channel. The user, by operating each fader of the channel strip 61, can adjust the outgoing level to the matrix 1-2 bus of each input channel.

A destination (a MIX bus) is displayed on each input channel of the channel strips 61. For example, a MIX 1-2 bus is displayed on the first input channel as the destination, and a MIX 3-4 bus is displayed on the second input channel as the destination.

An audio signal to be sent out to the MIX 1-2 bus is distributed in the PAN 354, as shown in FIG. 4, and is not subjected to the signal processing of localization addition other than the localization by the PAN. An audio signal to be sent out to the MIX 3-4 bus is subjected to the signal processing of localization addition in the signal processor 355.

The user, as with the example of FIG. 5, in the SENDS ON FADER mode with respect to the matrix 1-2 bus as the final outgoing destination, for each input channel, can adjust an amount of feed with respect to a destination that is previously associated with the each input channel. Therefore, the user can easily adjust the amount of feed of the input channel that performs signal processing of localization addition, and the amount of feed of the input channel that does not perform signal processing.

Figure 6:
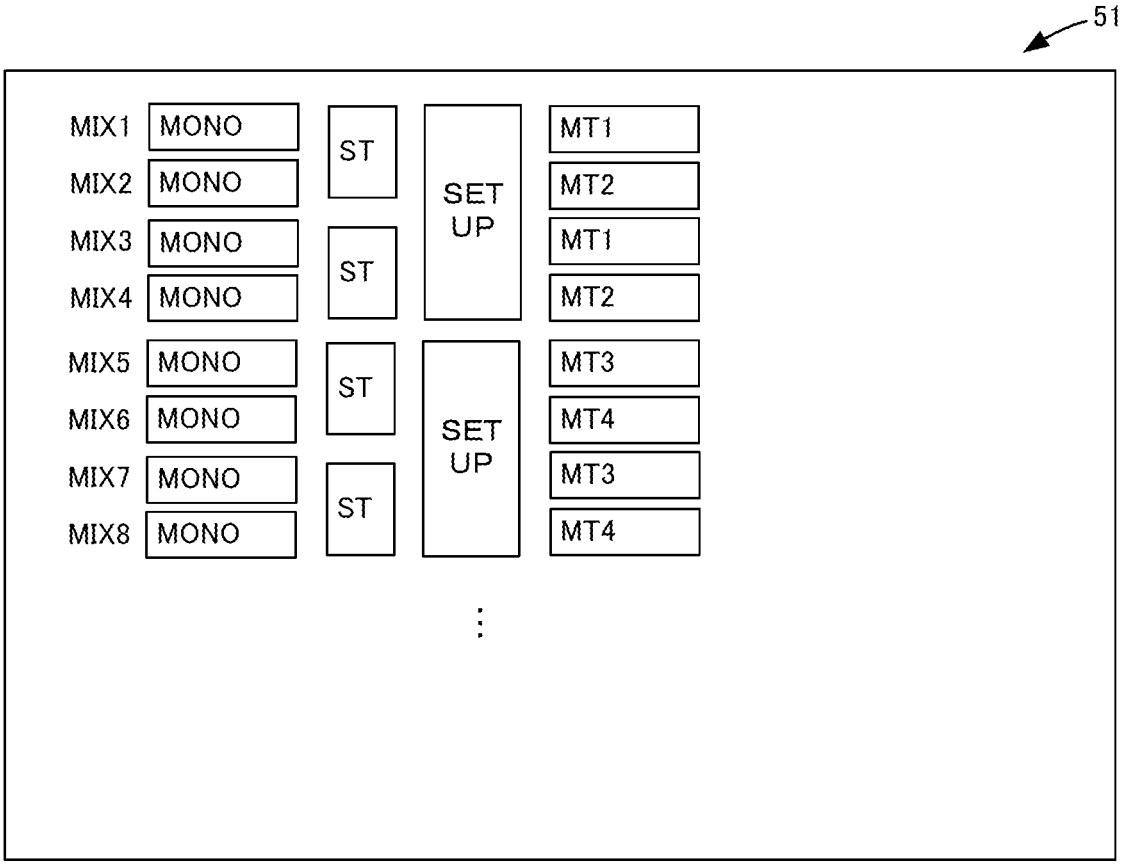
FIG. 6 is a diagram showing a setup screen of a MIX bus.

FIG. 6 is a diagram showing a setup screen of a MIX bus. In a setup screen of the MIX bus, for each MIX bus, the bus is set up. For example, each MIX bus may be set as either a monaural bus or a stereo bus. When "ST" displayed on the MIX1 and the MIX2 is selected, for example, the MIX1 and the MIX2 are associated with each other as a stereo bus. In addition, in the setup screen of a MIX bus, a destination (a routing destination) is set up for each MIX bus.

Figure 7:
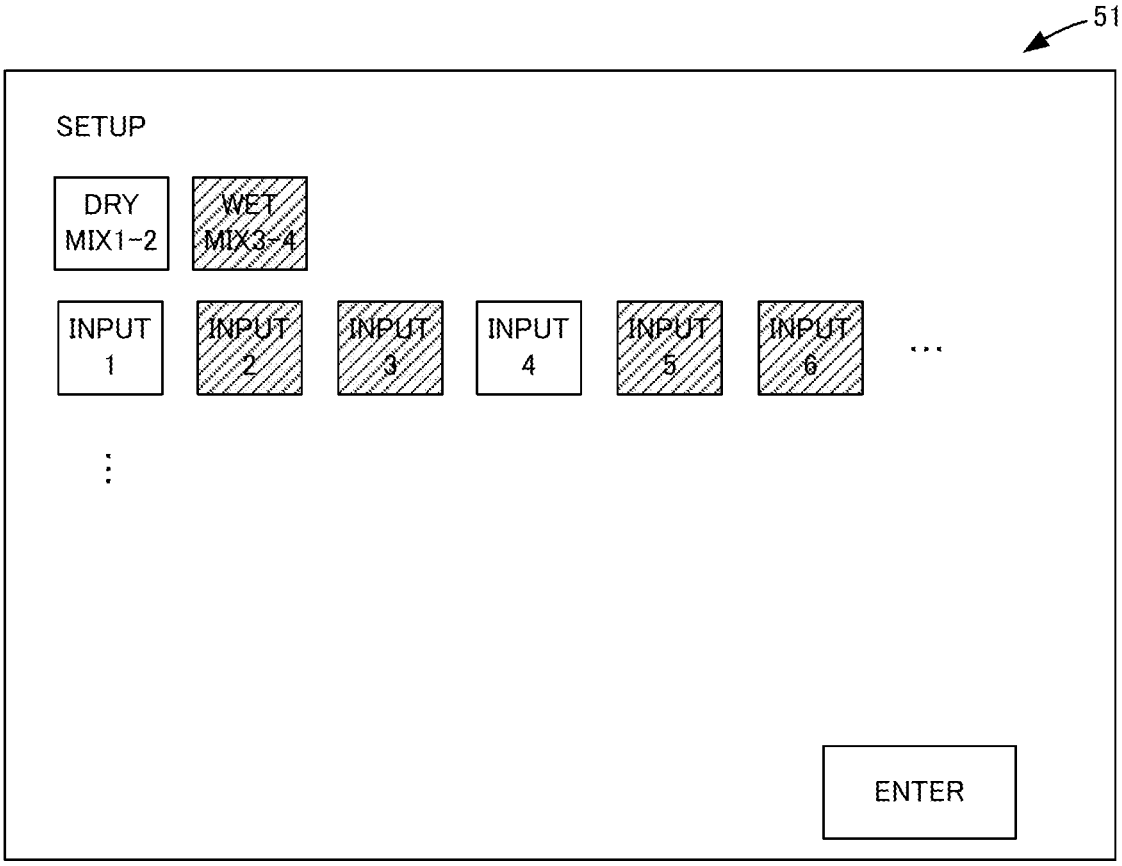
FIG. 7 is a diagram showing an example of a setup screen.

When the user selects "SETUP" corresponding to four MIX buses in the setup screen of a MIX bus, the touch screen 51 shifts to the setup screen shown in FIG. 7.

As shown in FIG. 7, the user, in the setup screen, for each input channel, can set as a list whether to send out to a bus that performs signal processing such as localization processing or whether to send out to a bus that does not perform signal processing that adds localization other than the localization by the PAN.

The MIX1-2 bus is a (DRY) bus to which an audio signal on which the signal processing such as localization processing is not performed, is sent out, and the MIX3-4 bus is a (WET) bus to which an audio signal on which the signal processing such as localization processing is performed, is sent out. In a case of WET, a display mode is changed. For example, the second input channel is deeply displayed since WET is selected.

When the user sets DRY or WET for each input channel and then selects ENTER, each input channel is assigned to the MIX1-2 bus being DRY or to the MIX3-4 bus being WET. As described above, the audio mixer 100 can simultaneously assign DRY or WET of each input channel.

Figure 8:
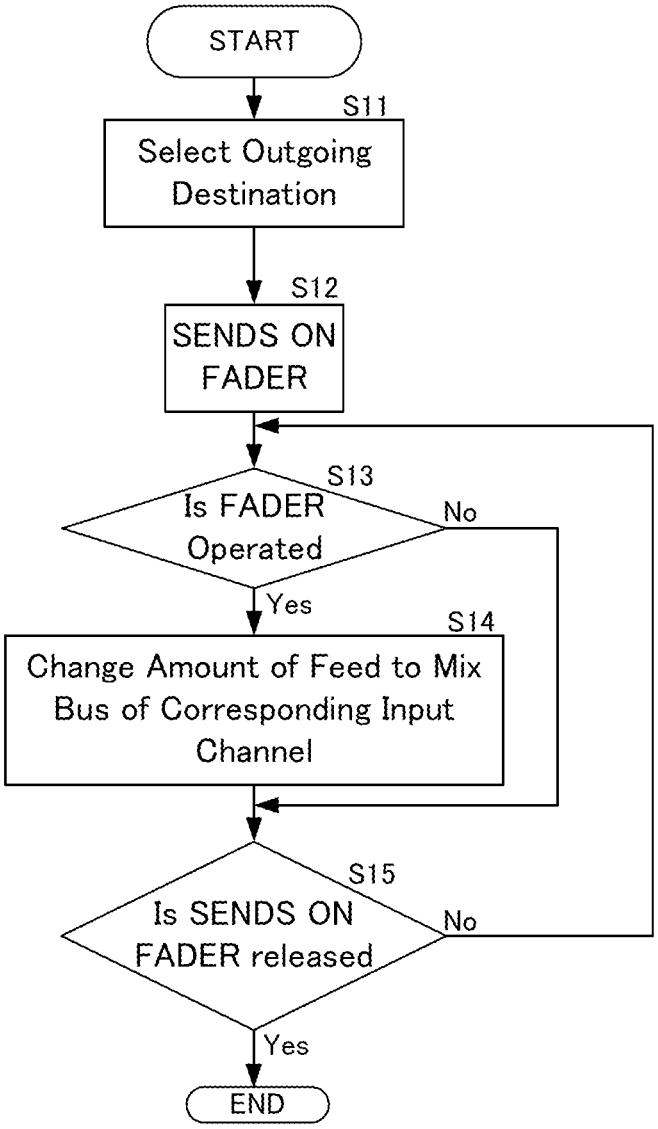
FIG. 8 is a flow chart showing an operation of an audio mixer 100.

FIG. 8 is a flow chart showing an operation of the audio mixer 100. The audio mixer 100, as shown in FIG. 5, first receives a selection of a bus (the MT1-2 bus, for example) of a target outgoing destination (S11). Subsequently, the audio mixer 100 receives instructions to shift to the SENDS ON FADER mode (S12). The audio mixer 100, as shown in FIG. 5, displays a touch switch of "SENDS ON FADER to MT 1-2" on the touch screen 51, and receives the instructions to shift to the SENDS ON FADER mode.

The audio mixer 100 then determines whether to have received a fader operation (S13). The audio mixer 100, in a case of having received the fader operation, changes the amount of feed to the MIX bus of the input channel corresponding to the operated fader (S14). For example, in the example of FIG. 5, in a case in which the fader of the first input channel is operated, the amount of feed to the MIX1-2 bus of the audio signal of the first input channel is changed.

Finally, the audio mixer 100 determines whether to have received a release operation of the SENDS ON FADER mode (S15). The audio mixer 100, when receiving no release operation, repeats the processing from the determination of S13.

It is to be noted that, although the above embodiment describes an example of performing mixing by routing a plurality of MIX buses to the matrix bus, the mixing may be performed in an output channel, for example.

In addition, although the present embodiment describes an example of sending out the audio signal of each input channel to the stereo bus, it is not essential to send out to the stereo bus in present disclosure. For example, when sending out an audio signal to one monitor speaker, the MIX bus may be a monaural bus. At least the audio signal of the input channel that does not perform signal processing such as localization processing may be sent out to a monaural bus.

In addition, in the above-described embodiment, the audio mixer 100 receives the setup of a destination in the setup screen shown in FIG. 7. However, the audio mixer 100, for example, may receive the setup of a destination in the channel strip 61 shown in FIG. 5. For example, the audio mixer 100 may place a touch panel in a portion (1-2 or 3-4) on which a destination is displayed, and may receive a destination for each input channel through the touch panel.

The description of the present embodiment is illustrative in all points and should not be construed to limit the present disclosure. The scope of the present disclosure is defined not by the foregoing embodiments but by the following claims. Further, the scope of the present disclosure is intended to include all modifications within the scopes of the claims of patent and within the meanings and scopes of equivalents.

Figure 9:
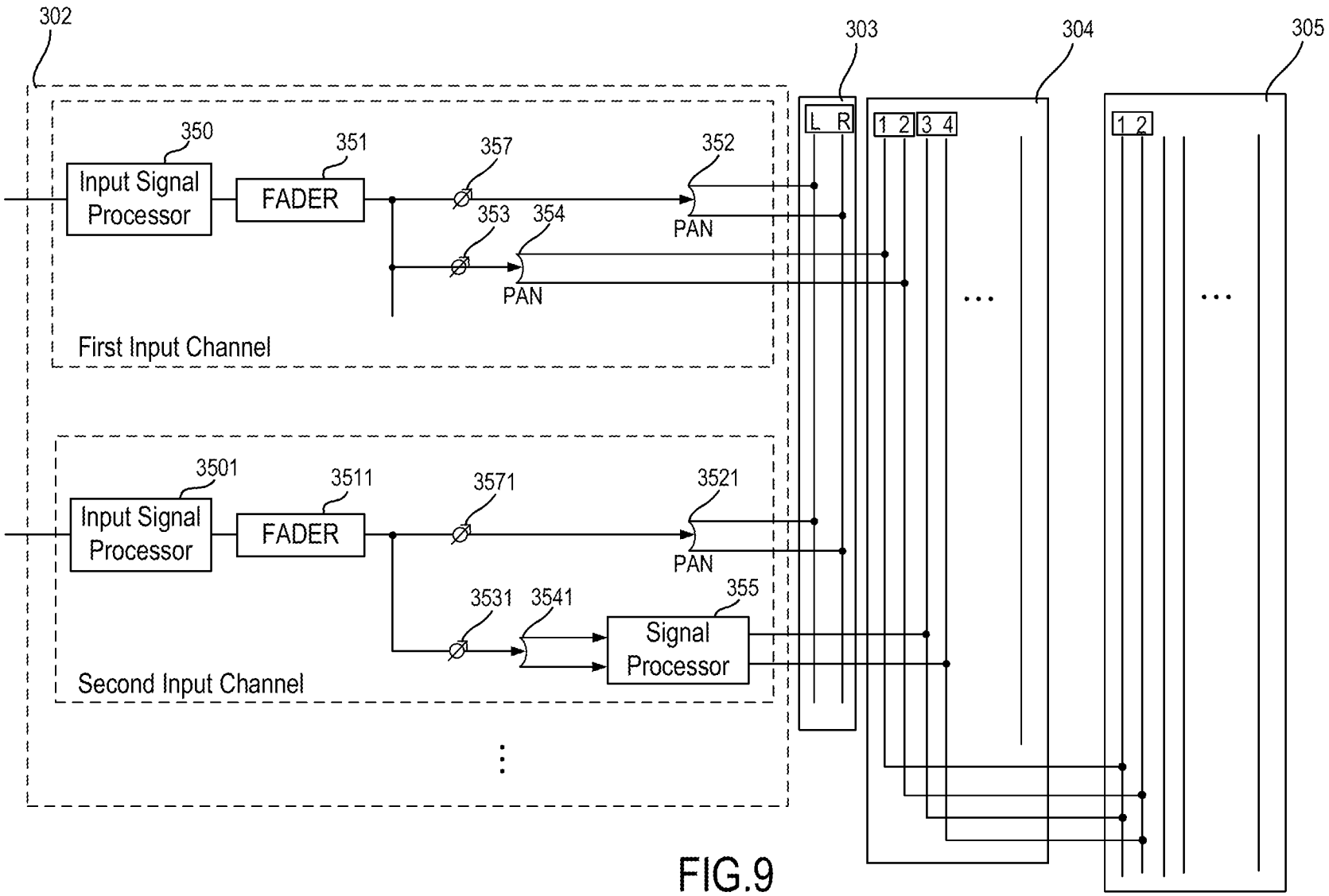
FIG. 9 is a diagram showing a configuration of an input channel and a bus.

For example, as shown in FIG. 9, the audio signal of the second input channel may be distributed in the PAN 3541. In such a case, the audio signal of the second input channel is subjected to the localization processing of both the right and left localization due to the distribution of the PAN 3541 and the localization based on the head-related transfer function of the signal processor 355.

Figure 10:
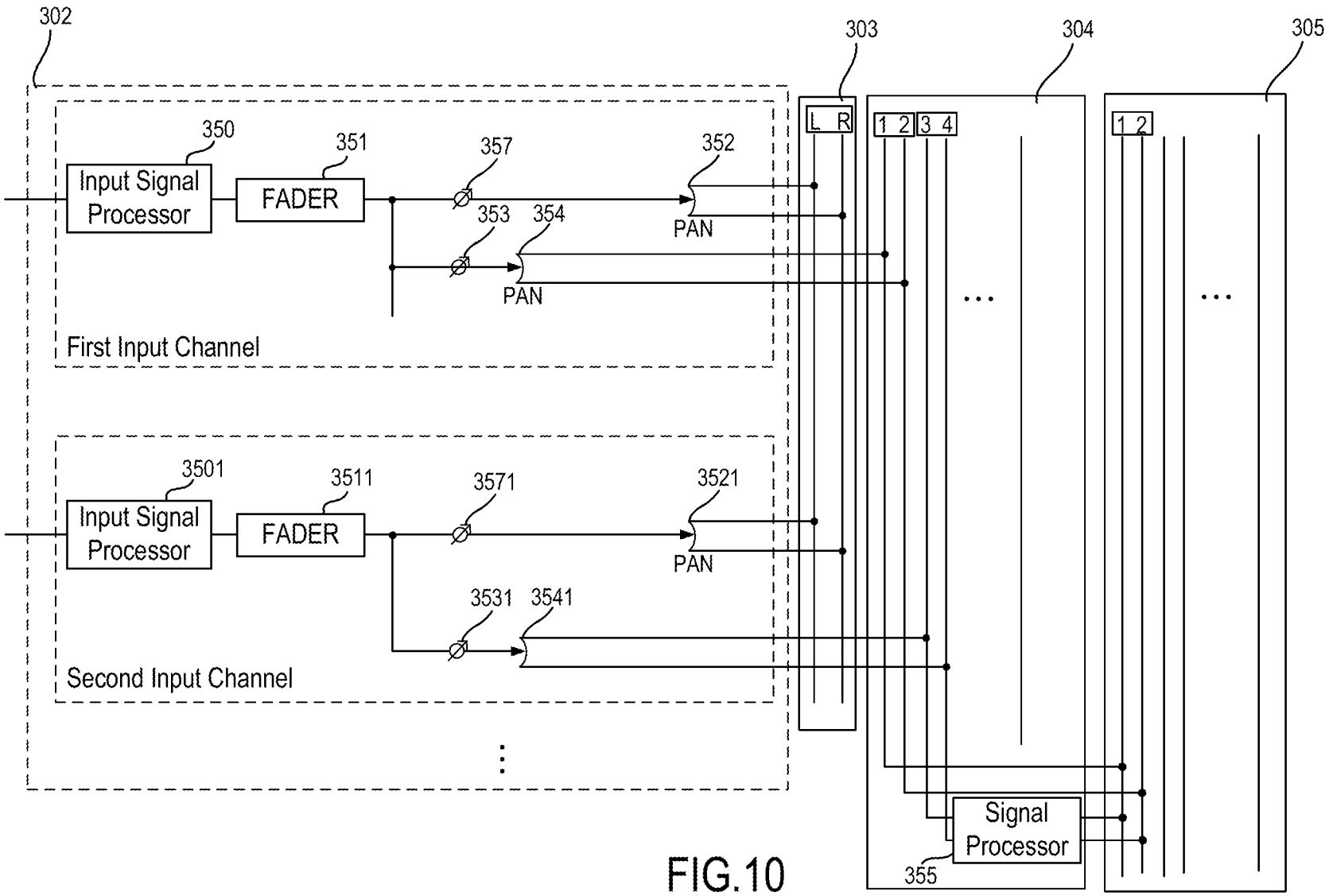
FIG. 10 is a diagram showing a configuration of an input channel and a bus.

In addition, as shown in FIG. 10, the signal processing may not be performed in the input channel, but may be performed in a bus of a destination to which an audio signal is sent out. In the example of FIG. 10, the signal processor 355 provided in the MIX3-4 bus performs signal processing.

In addition, the above embodiment describes an example of sending out the audio signal of the first input channel to the MIX1-2 bus and sending out the audio signal of the second input channel to the MIX3-4 bus. As a matter of course, the number of input channels and the number of buses are not limited to these examples. For example, the audio mixer 100 may send out the audio signal of a third input channel to a MIX5-6 bus, and may perform signal processing such as a head-related transfer function. Herein, the signal processing to be performed in the MIX5-6 bus may be the same as or may be different from the signal processing to be performed in the MIX3-4 bus. The signal processing to be performed in the MIX5-6 bus may provide a further stronger effect (a more distant localization effect) than the signal processing to be performed in the MIX3-4 bus. In such a case, a listener can concentrate on listening to the sound (the main vocal, for example) of the MIX1-2 bus, can listen to the sound (the sub vocal, for example) of the MIX3-4 bus so as to surround a surrounding of the vocal, and can listen to the sound (the chorus, for example) of the MIX5-6 bus so as to further surround the surrounding.

In addition, a setup of whether to perform localization processing is not limited to the example of FIG. 7. For example, the audio mixer 100 may receive whether to perform localization processing using the operation element provided on the operation panel. For another example, the audio mixer 100, in an ordinary mode (the first mode) that is not the SENDS ON FADER mode, when shifting to a state to set up the destination as shown in FIG. 7, may automatically set a channel selected by a SEL button (not shown) as WET and a channel not selected by the SEL button as DRY.

The audio mixer 100 may also automatically set each channel as WET or DRY based on the past history or the setup that a user has previously inputted. The audio mixer 100 may also automatically set each channel as WET or DRY based on a learned algorithm obtained by machine learning from the past history. For example, the audio mixer 100 may automatically set each channel as WET or DRY based on a channel name set to each channel. The element of input data at the time of performing the machine learning includes the number of an input channel, the name of an input channel (the name of a performer, the name of a musical instrument, or the like), an image associated with an input channel (an image of a musical instrument, for example), the number of a destination, or the name of a destination (the name of a performer, the name of a speaker, or the like). The element of output data is WET or DRY. The audio mixer 100 learns the past history according to the combination of the input data and the output data as teaching data. As an algorithm, a support vector machine or a neural network is able to be used. The neural network is also able to use a deep neural network including a convolutional neural network and a recurrent neural network.

The audio mixer 100, based on the learned algorithm, for example, sets a channel of which the channel name is vocal as DRY, and sets a channel of which the channel name is chorus as WET. In addition, in a case in which the name of a performer, the name of a musical instrument, an image of a musical instrument, or the like is associated with each channel, may set each channel as WET or DRY based on the name of a performer, the name of a musical instrument, or the image of a musical instrument. As a result, the user can shorten the setup time of whether to perform the localization processing by a head-related transfer function or the like, for each channel. The audio mixer 100 may also set each channel as WET or DRY based on the name of a destination in addition to information including the name of an input channel. In such a case, the audio mixer 100 is able to set each channel as WET or DRY in consideration of the preference of a performer corresponding to the destination or the characteristics of a speaker corresponding to the destination.

What is claimed is:

1. An audio signal processing apparatus comprising:

a WET bus;

a DRY bus;

a controller that assigns a first input channel to one of the WET bus and the DRY bus, assigns a second input channel to one of the WET bus and the DRY bus, receives an amount of feed from the first input channel to the bus to which the first input channel is assigned, and receives an amount of feed from the second input channel to the bus to which the second input channel is assigned;

a first signal processor that performs first signal processing on an audio signal to be input to each of the first input channel and the second input channel; and a second signal processor that performs second signal processing on the audio signal to be sent to the WET bus.

2. The audio signal processing apparatus according to claim 1, further comprising a PAN that performs first localization addition processing on the audio signal to be sent to the DRY bus, wherein the second signal processor performs second localization addition processing other than the first localization addition processing by the PAN on the audio signal to be sent to the WET bus.

3. The audio signal processing apparatus according to claim 1, wherein the WET bus includes the second signal processor.

4. The audio signal processing apparatus according to claim 1, further comprising a plurality of physical operation elements, wherein the controller receives the amount of feed from the first input channel to the bus to which the first input channel is assigned, a gain setting for the first input channel, the amount of feed from the second input channel to the bus to which the second input channel is assigned, and a gain setting for the second input channel through the plurality of physical operation elements.

5. The audio signal processing apparatus according to claim 4, further comprising an operation panel on which the plurality of physical operation elements are arranged side-by-side, wherein the controller assigns a physical operation element that receives the gain setting for the first input channel to the bus to which the first input channel is assigned from the plurality of physical operation elements and receives the amount of feed from the first input channel to the bus to which the first input channel is assigned through the assigned physical operation element, and assigns another physical operation element that receives the gain setting for the second input channel to the bus to which the second input channel is assigned and receives the amount of feed from the second input channel to the bus to which the second input channel is assigned through the another assigned physical operation element.

6. The audio signal processing apparatus according to claim 1, further comprising:

a first physical operation element and a second physical operation element; and a mode switch receiver that receives switching of a first mode and a second mode, wherein the controller, in the first mode, receives (i) a gain setting for the first input channel through the first physical operation element and (ii) a gain setting for the second input channel through the second physical operation element, and, in the second mode, receives (iii) the amount of feed from the first input channel to the bus to which the first input channel is assigned through the first physical operation element and (iv) the amount of feed from the second input channel to the bus to which the second input channel is assigned through the second physical operation element.

7. The audio signal processing apparatus according to claim 1, further comprising a matrix bus routed to the WET bus and the DRY bus that mixes the audio signal to be sent to the WET bus and the audio signal to be sent to the DRY bus, to thereby generate a mixed audio signal, and outputs the mixed audio signal to a predetermined output channel.

8. The audio signal processing apparatus according to claim 7, further comprising a first physical operation element and a second physical operation element, wherein:

the controller receives a selection of the matrix bus of a target outgoing destination for a SENDS ON FADER; and the controller, when receiving the selection, receives (i) the amount of feed from the first input channel to the bus to which the first input channel is assigned through the first physical operation element and (ii) the amount of feed from the second input channel to the bus to which the second input channel is assigned through the second physical operation element.

9. The audio signal processing apparatus according to claim 1, wherein the controller simultaneously assigns the first input channel to the one of the WET bus and the DRY bus and the second input channel to the one of the WET bus and the DRY bus.

10. The audio signal processing apparatus according to claim 1, wherein the DRY bus is a monaural bus.

11. An audio signal processing method comprising:

assigning a first input channel to one of a WET bus and a DRY bus;

assigning a second input channel to one of the WET bus and the DRY bus;

receiving an amount of feed from the first input channel to the bus to which the first input channel is assigned; and receiving an amount of feed from the second input channel to the bus to which the second input channel is assigned;

performing, by a first signal processor, first signal processing on an audio signal to be sent to each of the first input channel and the second input channel; and performing, by a second signal processor, second signal processing on the audio signal to be sent to the WET bus.

12. The audio signal processing method according to claim 11, further comprising performing, by a PAN, first localization addition processing on the audio signal to be sent to the DRY bus;

wherein second localization addition processing other than the first localization addition processing by the PAN is further performed on the audio signal to be sent to the WET bus by the second signal processor.

13. The audio signal processing method according to claim 11, wherein the second signal processor is included in the WET bus.

14. The audio signal processing method according to claim 11, further comprising receiving the amount of feed from the first input channel to the bus to which the first input channel is assigned, a gain setting for the first input channel, the amount of feed from the second input channel to the bus to which the second input channel is assigned, and a gain setting for the second input channel through a plurality of physical operation elements.

15. The audio signal processing method according to claim 14, wherein the plurality of physical operation elements are arranged side-by-side on an operation panel; and the audio signal processing method further comprises:

assigning a physical operation element that receives the gain setting for the first input channel to the bus to which the first input channel is assigned from the plurality of physical operation elements, and receiving the amount of feed from the first input channel to the bus to which the first input channel is assigned through the assigned physical operation element; and assigning another physical operation element that receives the gain setting for the second input channel to the bus to which the second input channel is assigned from the plurality of physical operation elements, and receiving the amount of feed from the second input channel to the bus to which the second input channel is assigned through the another assigned physical operation element.

16. The audio signal processing method according to claim 11, further comprising:

receiving switching of a first mode and a second mode;

receiving, in the first mode, (i) a gain setting for the first input channel through a first physical operation element and (ii) a gain setting for the second input channel through a second physical operation element; and receiving, in the second mode, (iii) the amount of feed from the first input channel to the bus to which the first input channel is assigned through the first physical operation element and (iv) the amount of feed from the second input channel to the bus to which the second input channel is assigned through the second physical operation element.

17. The audio signal processing method according to claim 11, further comprising mixing, by a matrix bus routed to the WET bus and the DRY bus, the audio signal to be sent to the WET bus and the audio signal to be sent to the DRY bus, to thereby generate a mixed audio signal, and outputting the mixed audio signal to a predetermined output channel.

18. The audio signal processing method according to claim 17, further comprising:

receiving a selection of the matrix bus of a target outgoing destination for a SENDS ON FADER; and when the selection is received, receiving (i) the amount of feed from the first input channel to the bus to which the first input channel is assigned through a first physical operation element and (ii) the amount of feed from the second input channel to the bus to which the second input channel is assigned through a second physical operation element.

19. The audio signal processing method according to claim 11, wherein the first input channel and the second input channel are simultaneously assigned to the one of the WET bus and the DRY bus.

20. The audio signal processing method according to claim 11, wherein the DRY bus is a monaural bus.

* * * * *